US008727515B2

(12) United States Patent
Dowell et al.

(10) Patent No.: US 8,727,515 B2
(45) Date of Patent: May 20, 2014

(54) CONTAINER INSTALLATION GUIDE FOR A FLUID EJECTOR ASSEMBLY

(75) Inventors: Daniel D. Dowell, Albany, OR (US); Curt Gonzales, Corvallis, OR (US); Bruce A. McFadden, Vancouver, WA (US); Jeffrey T. Hendricks, Camas, WA (US); David Welter, Corvallis, OR (US); Mark A. Smith, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 441 days.

(21) Appl. No.: 12/995,131

(22) PCT Filed: May 31, 2008

(86) PCT No.: PCT/US2008/065453

§ 371 (c)(1),
(2), (4) Date: Apr. 19, 2011

(87) PCT Pub. No.: WO2009/145792

PCT Pub. Date: Dec. 3, 2009

(65) Prior Publication Data

US 2011/0205297 A1 Aug. 25, 2011

(51) Int. Cl.
*B41J 2/165* (2006.01)

(52) U.S. Cl.
USPC ..... 347/86

(58) Field of Classification Search
None
See application file for complete search history.

(56) References Cited

U.S. PATENT DOCUMENTS

| | | | | |
|---|---|---|---|---|
| 6,966,631 | B2 * | 11/2005 | Matsuo et al. | 347/49 |
| 2007/0242117 | A1 * | 10/2007 | Ishizawa et al. | 347/86 |

FOREIGN PATENT DOCUMENTS

| | | | |
|---|---|---|---|
| EP | 1048468 | | 11/2000 |
| JP | 11-78043 | A | 3/1999 |
| JP | 2000-127428 | A | 5/2000 |
| JP | 2001-10077 | A | 1/2001 |
| JP | 2001-130022 | A | 5/2001 |

OTHER PUBLICATIONS

Translation of JP 2001-010077 Hayashi.*
Translation of JP 2001-130022 Iwanaga.*
Photographs of a Canon ink tank latch and guide for a printhead assembly.
Extended European Search Report dated Feb. 28, 2013 issued on EP Patent Application No. 08780735.0 filed on May 31, 2008, European Patent Office.

* cited by examiner

*Primary Examiner* — Alejandro Valencia

(57) ABSTRACT

In one embodiment, a fluid ejector assembly includes: a bay for holding a detachable fluid container that includes a fluid outlet at a forward part of the container; a fluid ejector; a fluid inlet at a forward part of the bay through which fluid from the outlet of a fluid container installed in the bay may pass to the fluid ejector; and a stationary guide configured to block an improper installation of a fluid container into the bay without also blocking a proper installation of the fluid container into the bay.

18 Claims, 13 Drawing Sheets

CONTAINER INSTALLATION GUIDE FOR A FLUID EJECTOR ASSEMBLY

RELATED APPLICATIONS

The present application claims the priority under 35 U.S.C. 119(a)-(d) or (f) and under C.F.R. 1.55(a) of previous International Patent Application No.: PCT/US2008/065453, filed May 31, 2008, entitled "Container Installation Guide for a Fluid Ejector Assembly", which application is incorporated herein by reference in its entirety.

BACKGROUND

Inkjet printers typically utilize a printhead that includes an array of orifices (also called nozzles) through which ink is ejected on to paper or other print media. One or more printheads may be mounted on a movable carriage that traverses back and forth across the width of the paper feeding through the printer. A printhead may be an integral part of an ink cartridge or part of a discrete assembly to which ink is supplied from a separate, often detachable ink container. For printhead assemblies that utilize detachable ink containers, it is important for the user to position the container correctly during installation to establish a good connection between the container outlet and the printhead assembly inlet and thereby ensure that ink will flow properly from the container to the printhead(s). Also, the user must remove the shipping cap that covers the outlet of a new ink container before installing the container in the printhead assembly. While this might seem obvious, the process of installing an ink container can be difficult for users who are not familiar with this type of inkjet printing system, particularly for those users who may not always read and follow installation instructions that accompany the products.

DRAWINGS

Figure 2:
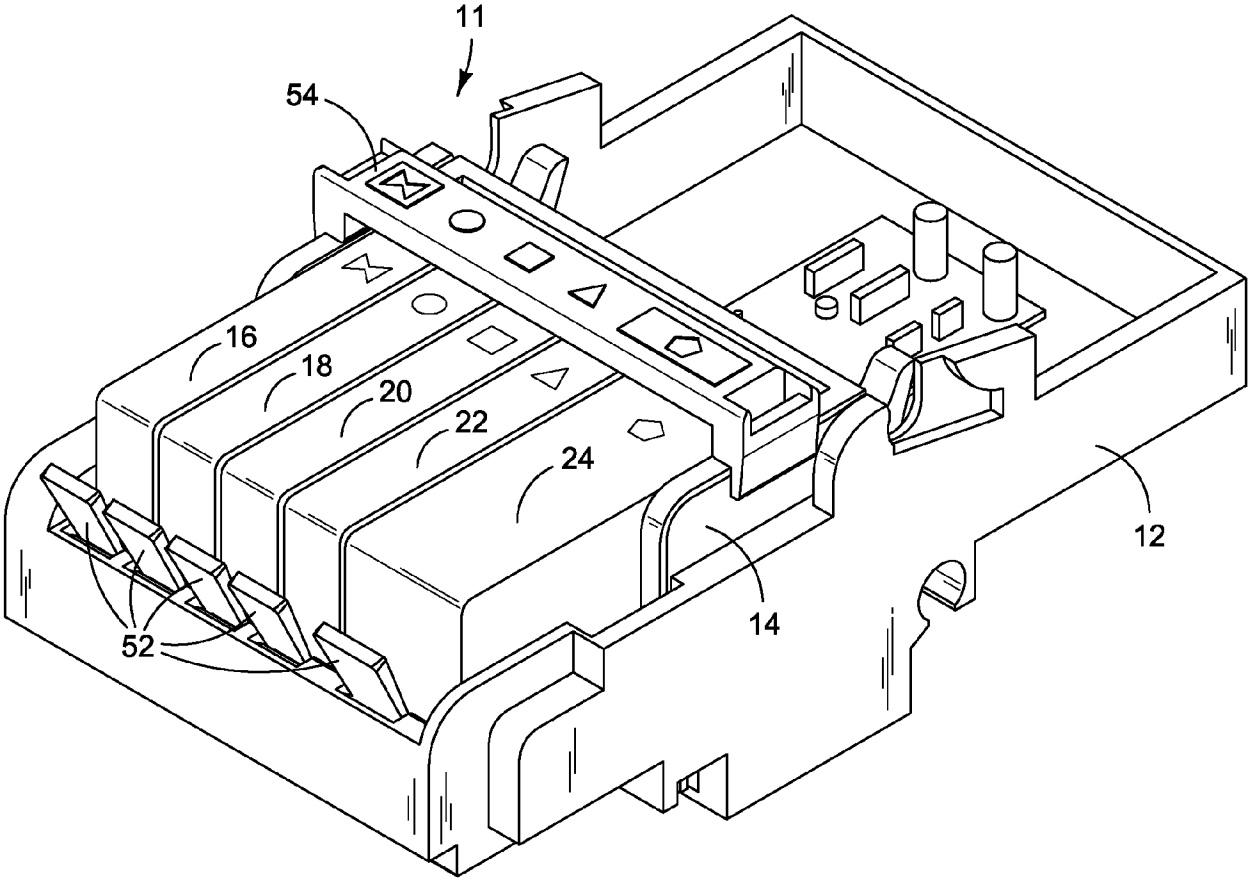
FIGS. 2-4 are perspective views of one embodiment of a carriage/printhead assembly, such as might be used in the printer of FIG. 1, with the ink containers exploded out from the carriage in FIGS. 3 and 4 to show the inlets to the printhead assembly (FIG. 3) and the outlets from the ink containers (FIG. 4).
Figure 3:
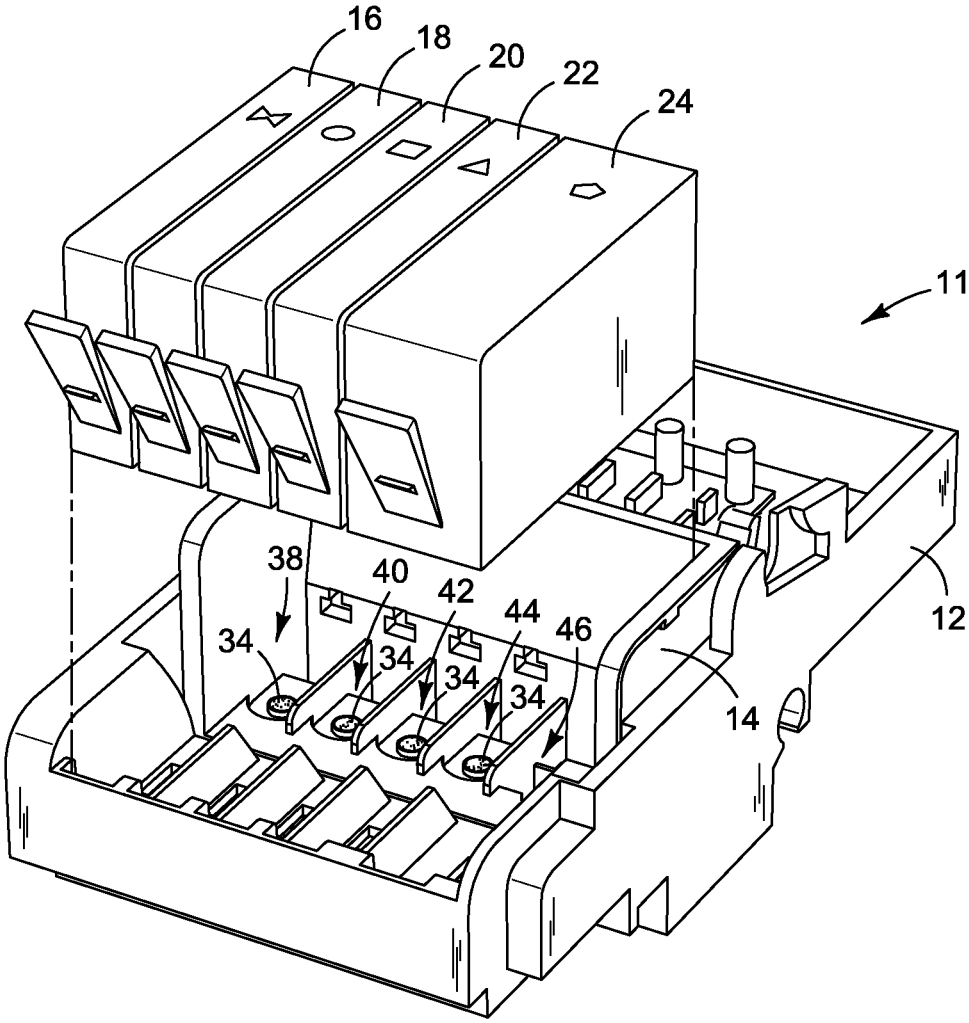
Figure 4:
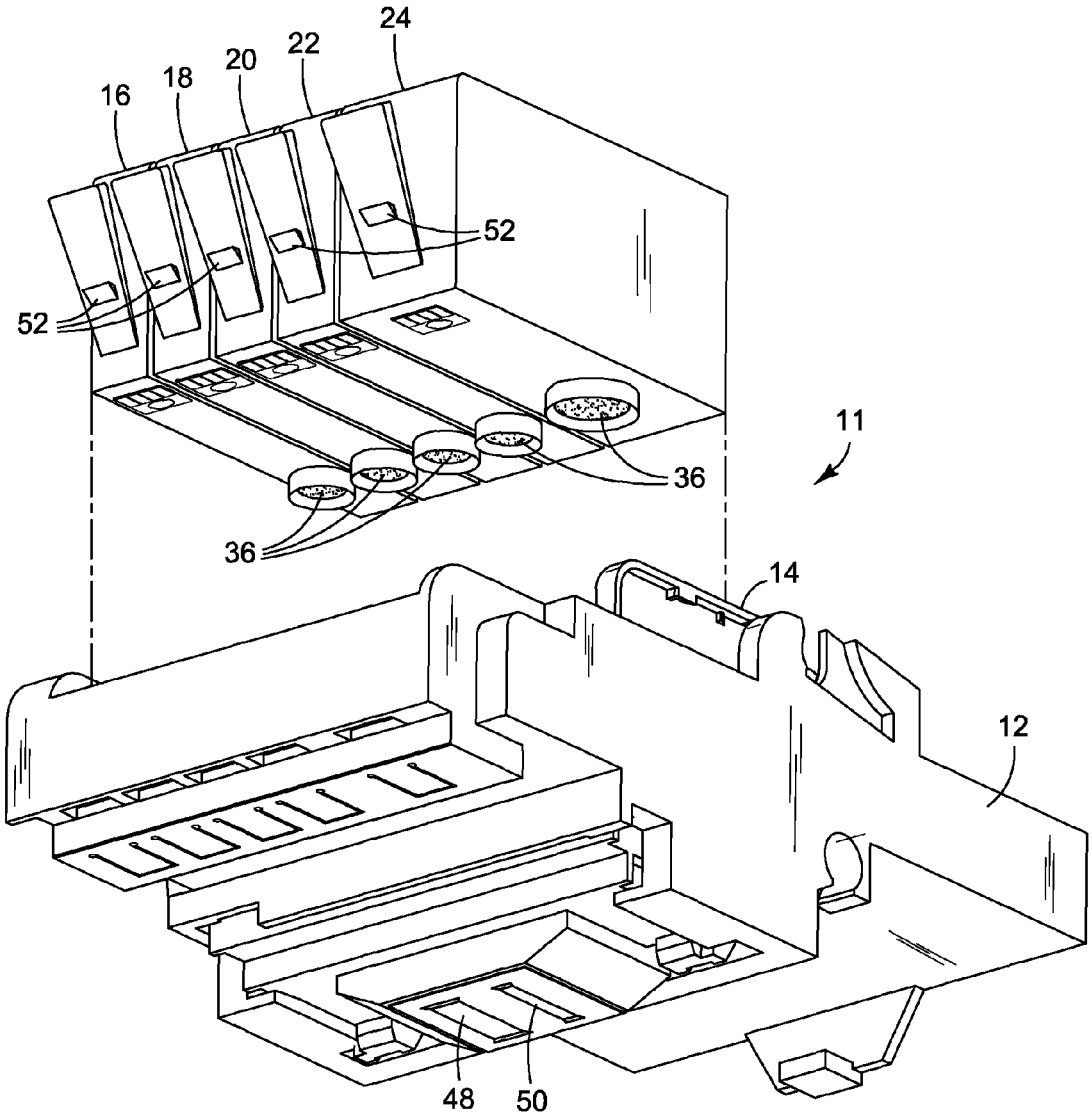
Figure 5:
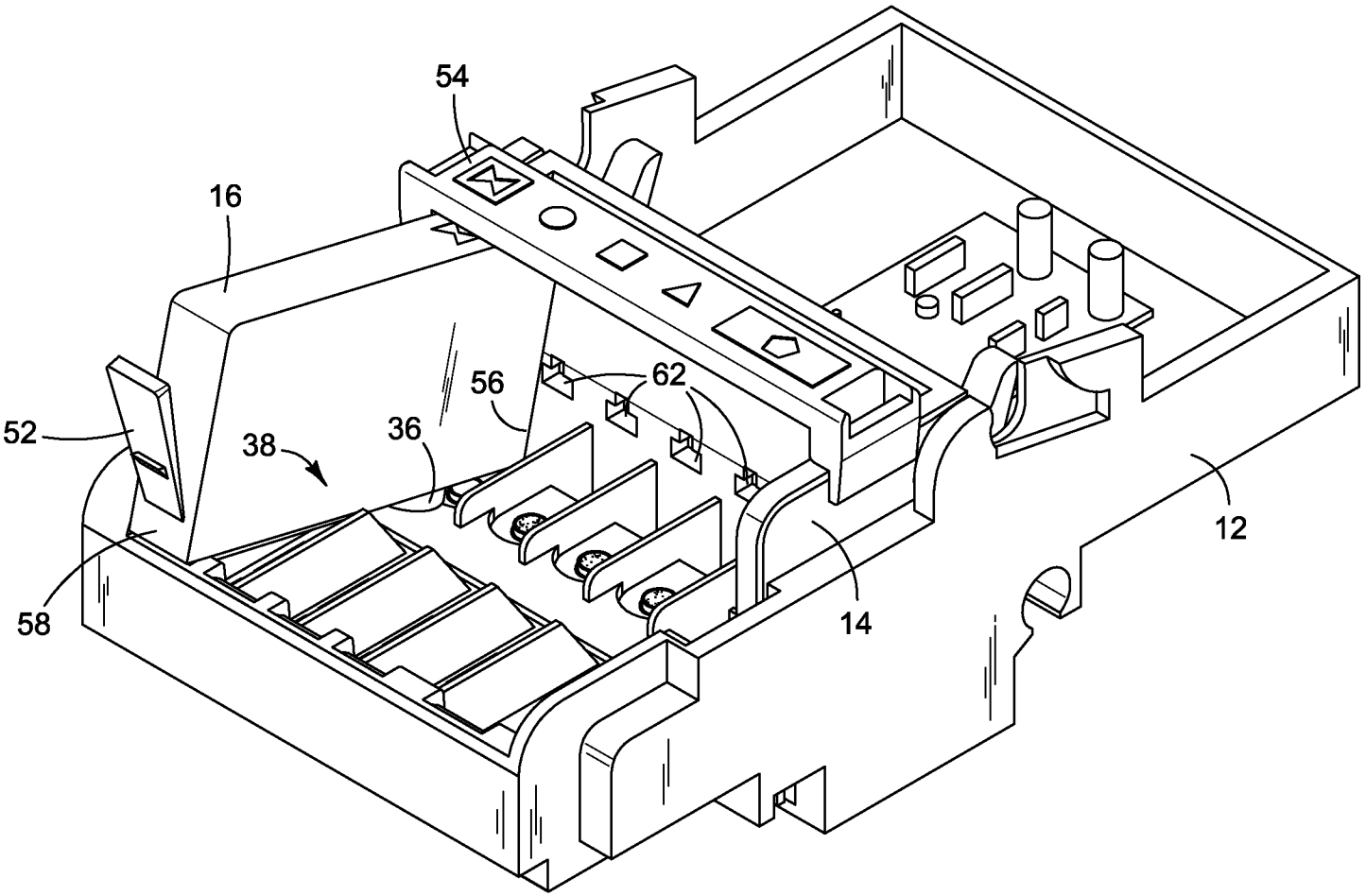
Figure 6:
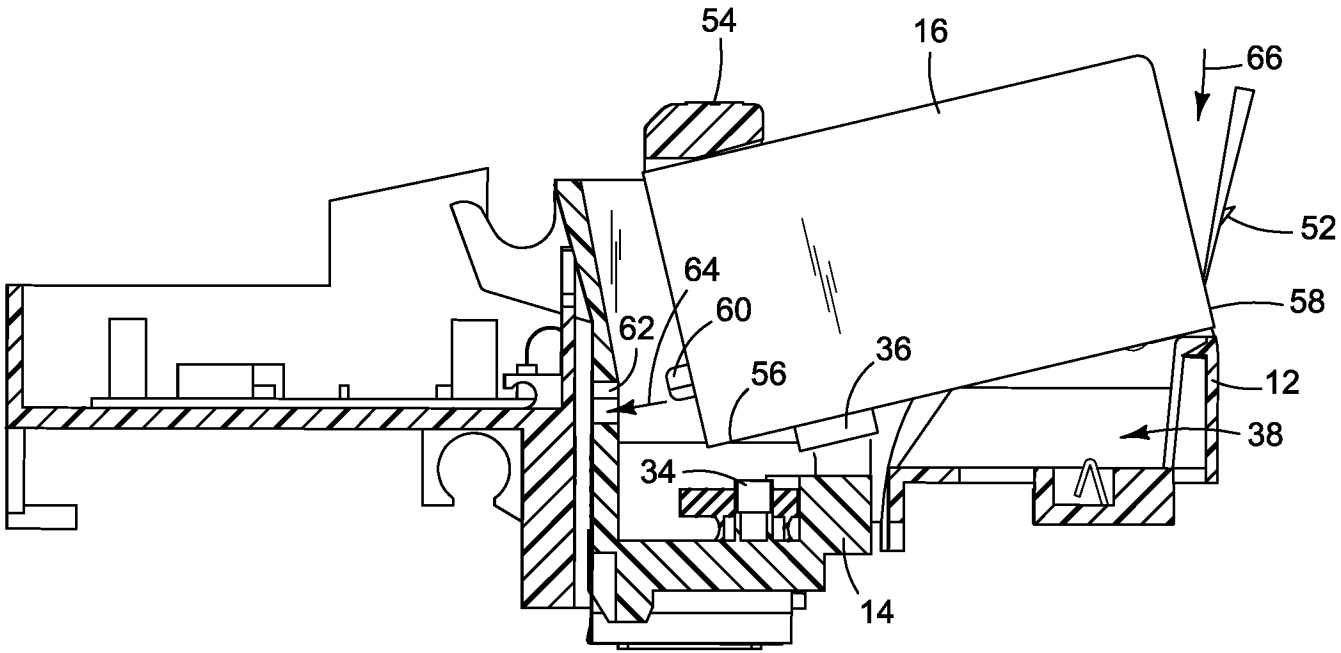
Figure 7:
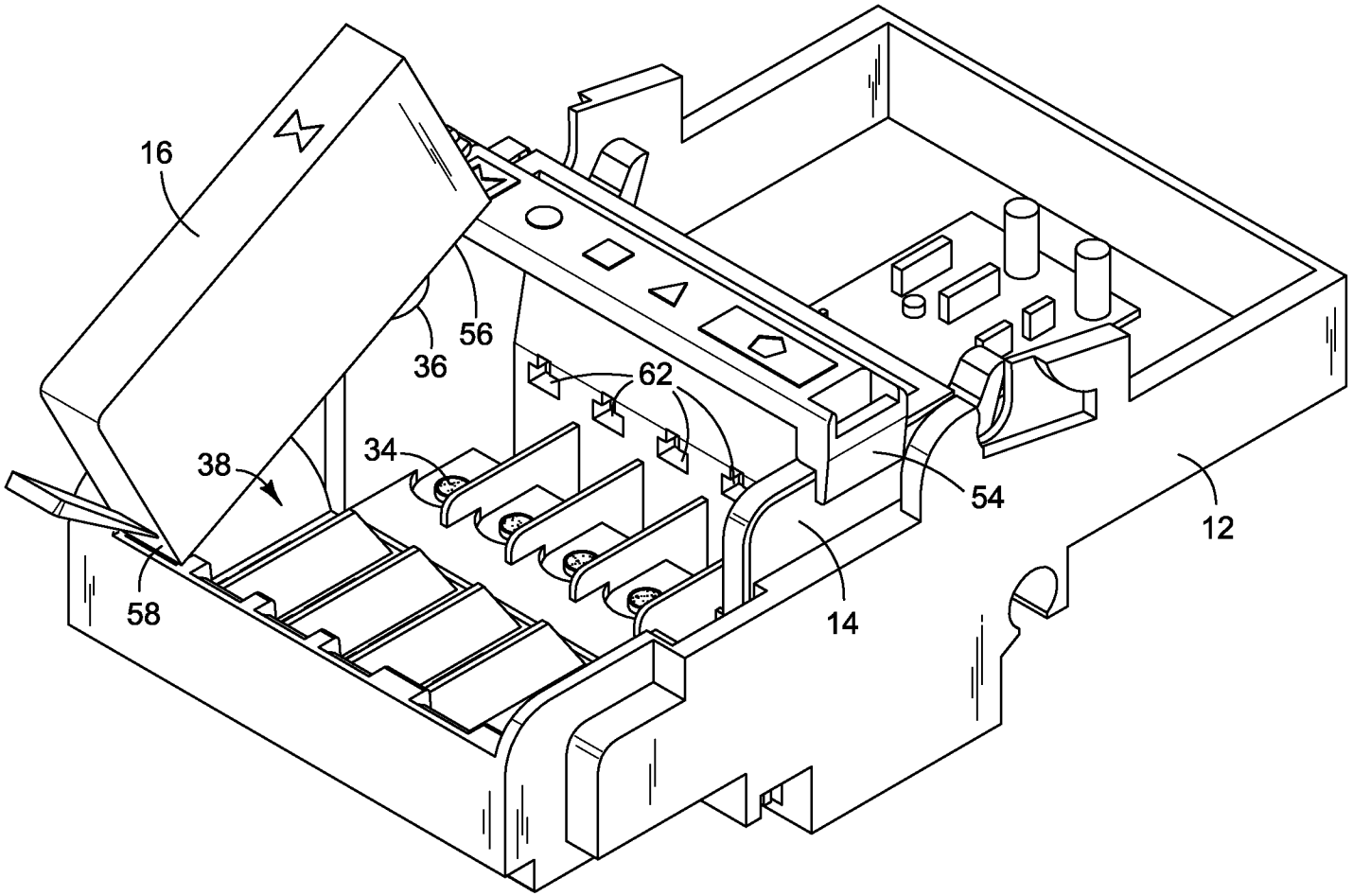
Figure 8:
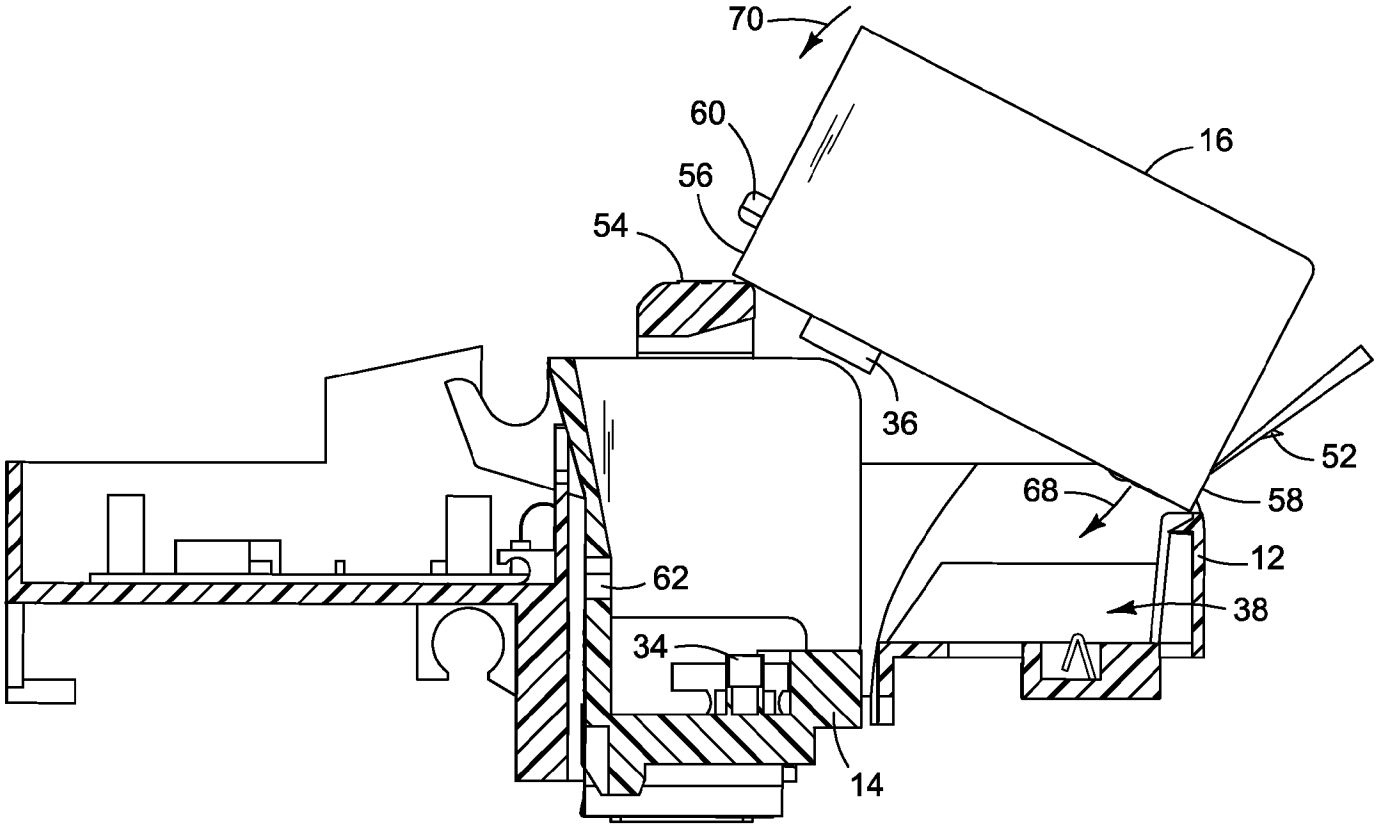
Figure 9:
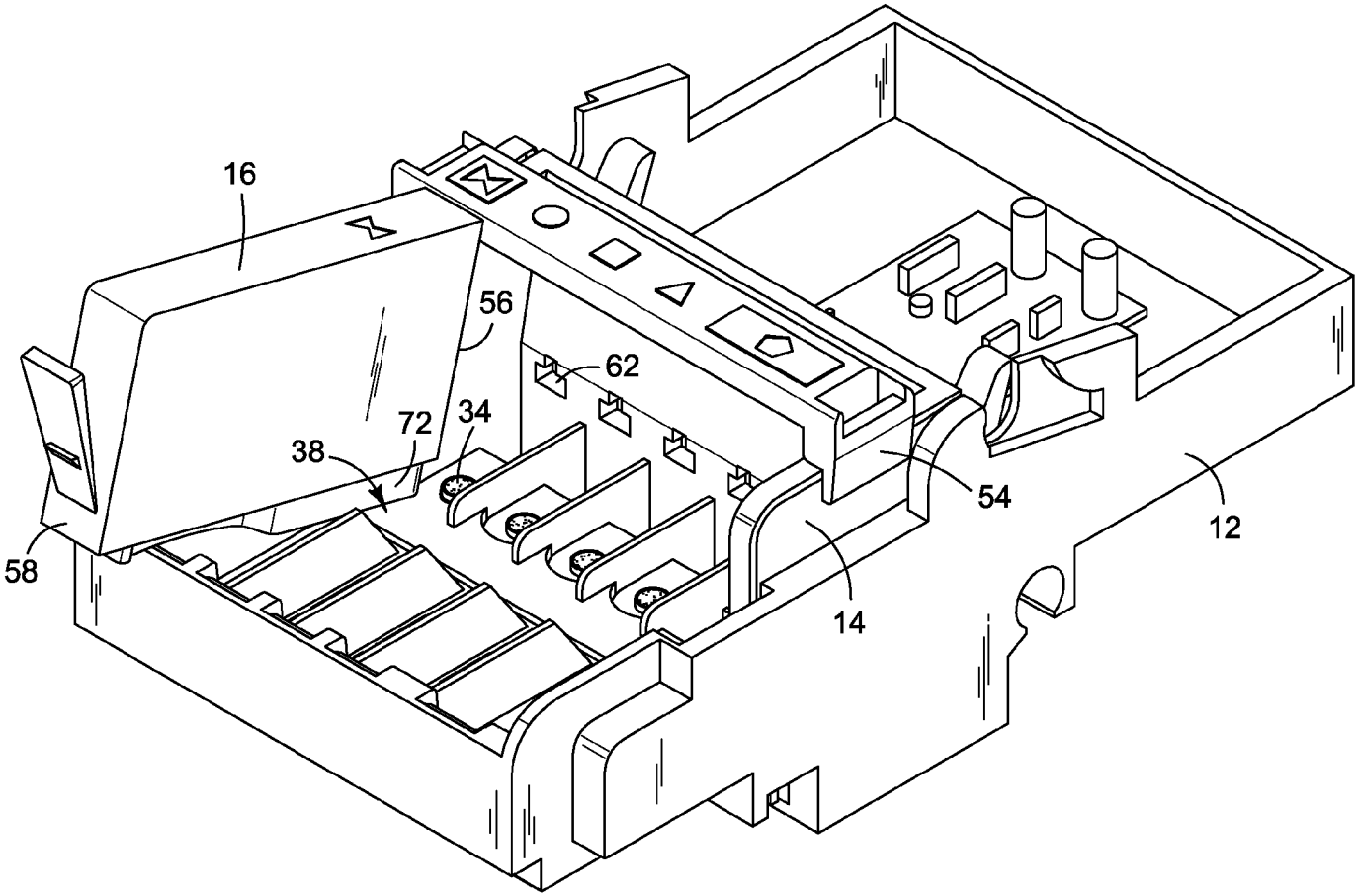
Figure 10:
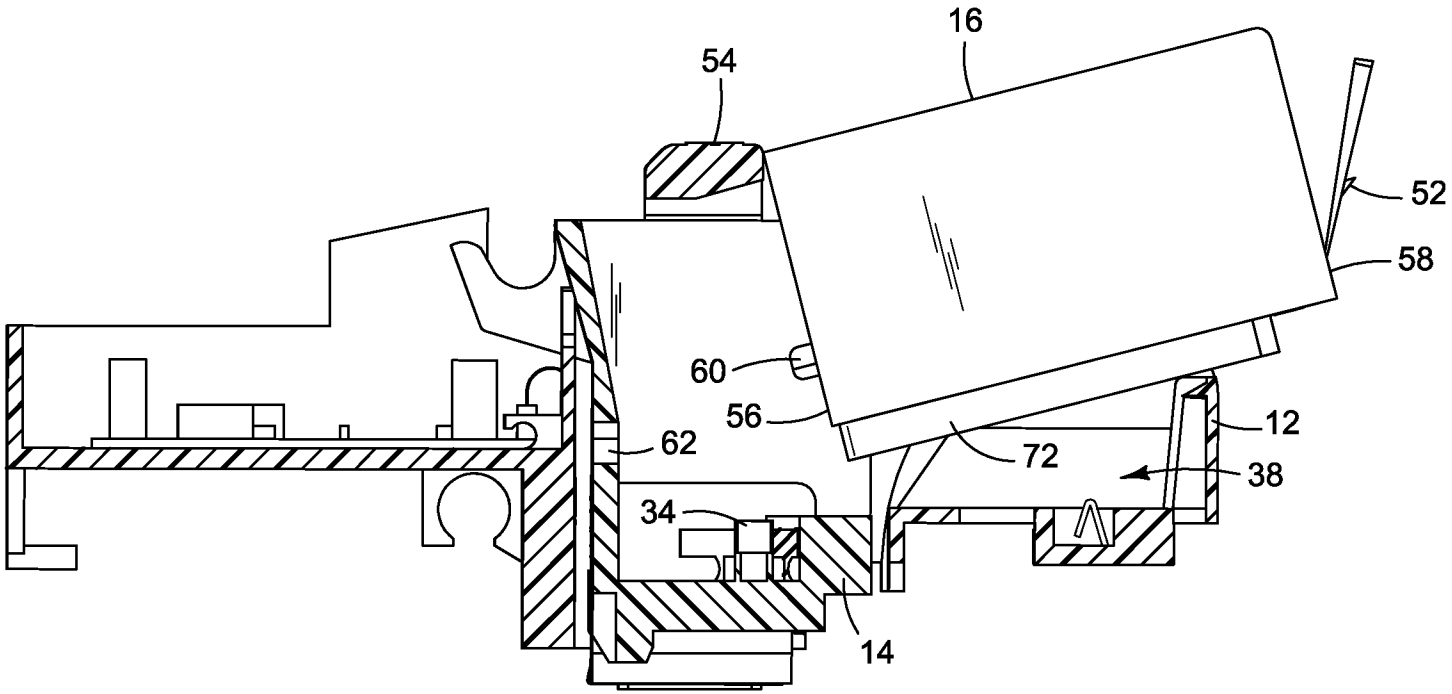

FIGS. 5-6, 7-8 and 9-10 are perspective and section view pairs of the assembly of FIGS. 2-4 with an ink container in various installation positions to illustrate the effect of the container installation guide. FIGS. 5-6 show a correct, toe-to-heel installation. FIGS. 7-8 show an incorrect, heel-to-toe installation blocked by the guide. FIGS. 9-10 show an incorrect installation, in which the shipping cap has not been removed from container outlet, blocked by the guide.

Figure 11:
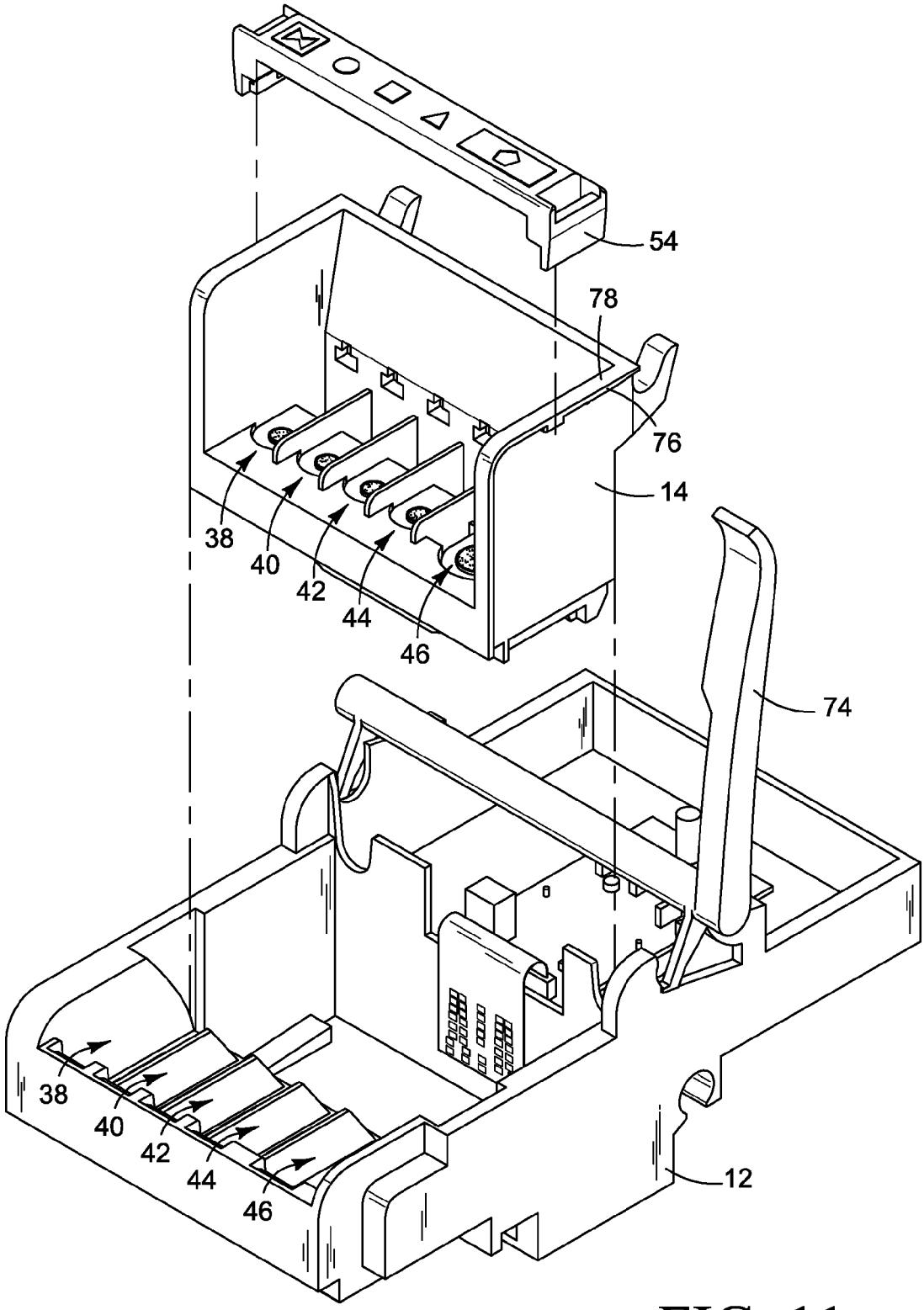

FIG. 11 is a perspective exploded view of one embodiment of a carriage/printhead assembly in which the carriage, printhead assembly and container installation guide are each discrete components fastened together.

FIGS. 12-16 illustrate one example snap fit for fastening a detachable container installation guide to a printhead assembly.

DESCRIPTION

Embodiments of the disclosure were developed to help the user position ink containers correctly during installation into a printhead assembly and to prevent the installation of an ink container from which the shipping cap has not been removed.

Embodiments will be described, therefore, with reference to an inkjet printhead assembly that holds detachable/replaceable ink containers. Embodiments of the disclosure, however, are not limited to such implementations. Embodiments of the disclosure, for example, might also be implemented in other types of ink or fluid dispensing components. The example embodiments shown in the Figures and described below, therefore, illustrate but do not limit the scope of the disclosure.

Figure 1:
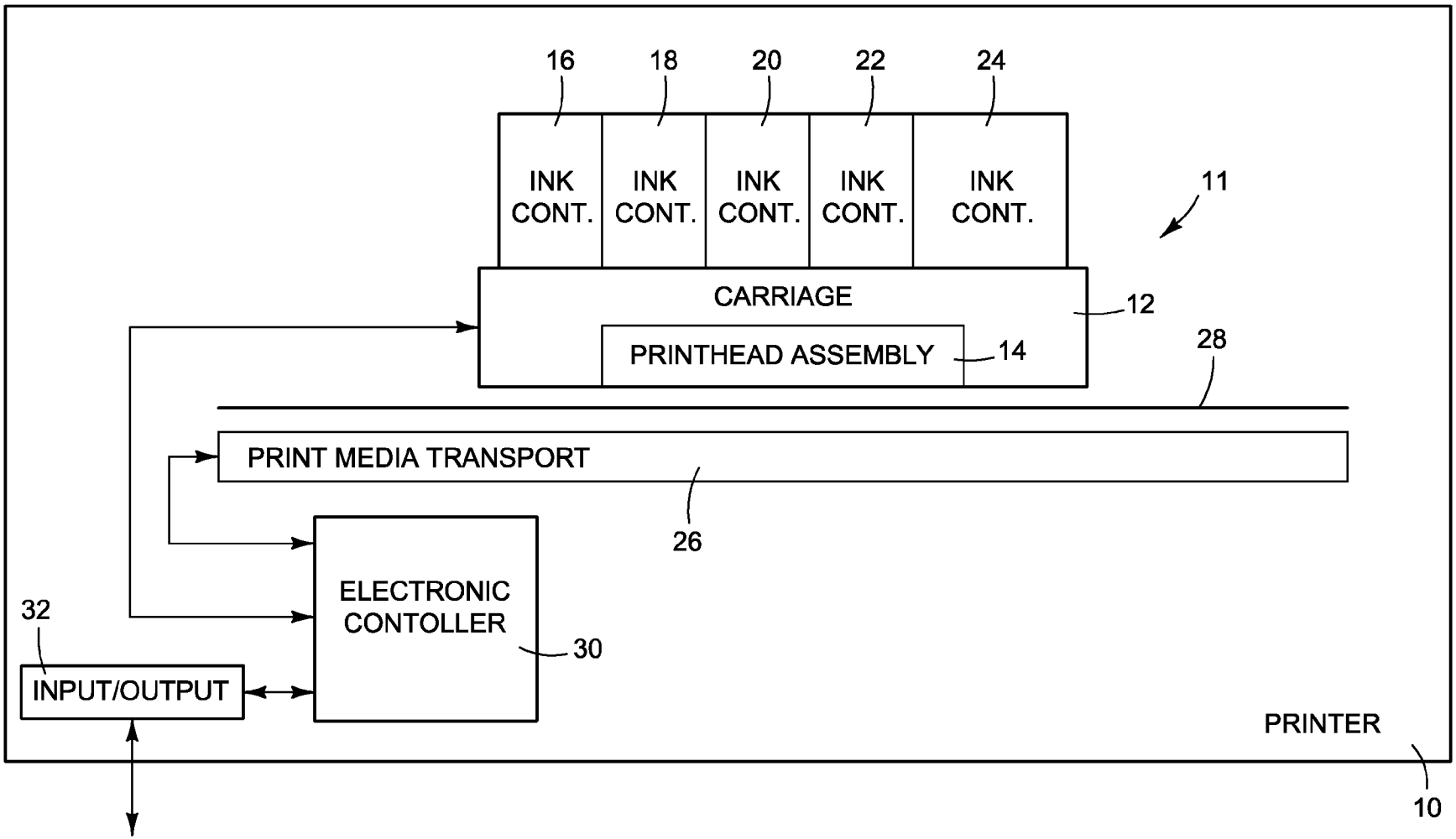
FIG. 1 is a block diagram illustrating an inkjet printer.

FIG. 1 is a block diagram illustrating an inkjet printer 10 in which embodiments of the disclosure may be implemented. Referring to FIG. 1, printer 10 includes a carriage/printhead assembly 11 that includes a carriage 12 carrying a printhead assembly 14. Printer 10 also includes detachable ink containers 16, 18, 20, 22, and 24 installed in assembly 11. Inkjet printer 10 and printhead assembly 14 represent more generally a fluid-jet precision dispensing device and fluid ejector assembly for precisely dispensing a fluid, such as ink, as described in more detail below. Printhead assembly 14 includes a printhead (not shown) through which ink from one or more containers 16-24 is ejected. For example, printhead assembly 14 may include two printheads—one for a series of color containers 16-22 and one for a black ink container 24. An inkjet printhead is typically a small electromechanical assembly that contains an array of miniature thermal, piezoelectric or other devices that are energized or activated to eject small droplets of ink out of an associated array of orifices. A typical thermal inkjet printhead, for example, includes an orifice plate arrayed with ink ejection orifices and firing resistors formed on an integrated circuit chip.

A print media transport mechanism 26 advances print media 28 lengthwise past carriage 12 and printhead assembly 14. For a stationary carriage 12, media transport 26 may advance media 28 continuously past carriage 12. For a movable, scanning carriage 12, media transport 26 may advance media 28 incrementally past carriage 12, stopping as each swath is printed and then advancing media 28 for printing the next swath. An electronic controller 30 is operatively connected to a moveable scanning carriage 12, printhead assembly 14 and media transport 26. Controller 30 communicates with external devices through an input/output device 32, including receiving print data for inkjet imaging. The presence of an input/output device 32, however, does not preclude the operation of printer 10 as a stand alone unit. Controller 30 controls the movement of carriage 12 and media transport 26. Controller 30 is electrically connected to each printhead in printhead assembly 14 to selectively energize the firing resistors, for example, to eject ink drops on to media 28. By coordinating the relative position of carriage 12 with media 28 and the ejection of ink drops, controller 30 produces the desired image on media 28.

While this Description is at least substantially presented to inkjet-printing devices that eject ink onto media, those of ordinary skill within the art can appreciate that embodiments of the present disclosure are more generally not so limited. In general, embodiments of the present disclosure pertain to any type of fluid-jet precision dispensing device or ejector assembly for dispensing a substantially liquid fluid. The fluid-jet precision dispensing device precisely prints or dispenses a substantially liquid fluid in that the latter is not substantially or primarily composed of gases such as air. Examples of such substantially liquid fluids include inks in the case of inkjet printing devices. Other examples of substantially liquid fluids include drugs, cellular products, organisms, chemicals, fuel, and so on, which are not substantially or primarily composed of gases such as air and other types of gases. Therefore, while the Description is described in relation to an inkjet printer and inkjet printhead assembly for ejecting ink onto media, embodiments of the present disclosure more generally pertain to any type of fluid-jet precision dispensing device or fluid ejector structure for dispensing a substantially liquid fluid.

FIGS. 2-4 are perspective views of one embodiment of a carriage/printhead assembly 11. Ink containers 16-24 are exploded out from carriage 12 in FIGS. 3 and 4 to show ink inlets 34 to printhead assembly 14 (FIG. 3) and ink outlets 36 from ink containers 16-24 (FIG. 4). Referring to FIGS. 2-4, printhead assembly 14 includes an ink inlet 34 positioned at each bay 38, 40, 42, 44, and 46 (FIG. 3) for a corresponding ink container 16-24. Printhead assembly 14 and carriage 12 may be integrated together as a single part or printhead assembly 14 may be detachable from carriage 12. For a detachable printhead assembly 14, container bays 38-46 may extend out into carriage 12 as necessary or desirable to properly receive and hold containers 16-24.

Referring specifically to FIG. 4, in the embodiment shown, printhead assembly 14 includes two printheads 48 and 50. Ink from color ink containers 16-22, for example, is ejected from printhead 48 and ink from a black container 24 is ejected from printhead 50. Each ink container 16-24 includes an ink outlet 36 through which ink may flow from container 16-24 through an inlet 34 (FIG. 3) to a corresponding printhead 48 or 50 through passageways (not shown) in printhead assembly 14. Each ink container 16-24 also include a latch 52 that snaps into the rear of each bay 38-46 to help secure each container 16-24 into a bay 38-46. As best seen in FIG. 2, an installation guide 54 attached to printhead assembly 14 spans container bays 38-46 at a level just above the tops of containers 16-24. As described in detail below, guide 54 helps the user position each container 16-24 correctly during installation into printhead assembly 14 and prevents the installation of an ink container 16-24 if the shipping cap has not been removed.

FIGS. 5-6, 7-8 and 9-10 are perspective and section view pairs of carriage/printhead assembly 11 with an ink container 16 in various installation positions to illustrate the effect of installation guide 54. In the following description, the forward part 56 of container 16 is referred to as the toe of the container and the rearward part 58 is referred to as the heel of the container. Container outlet 36 is located toward the toe 56 and latch tab 52 is located at the heel 58. A key 60 at the front 56 of each container 16-24 fits into a mating keyway 62 in printhead assembly 14 as indicated by direction arrow 64 in FIG. 6.

FIGS. 5-6 show a correct, toe-to-heel installation. Referring to FIGS. 5 and 6, container 16 is oriented with toe 56 down slightly and heel 58 up slightly so that the toe 56 can slide in under guide 54. A toe-to-heel installation motion, as indicated by direction arrows 64 and 66 in FIG. 6, brings container outlet 36 in and down over printhead assembly inlet 34 at the front of bay 38 and then latch tab 52 at heel 58 down into the rear of bay 38.

FIGS. 7-8 show an incorrect, heel-to-toe installation blocked by guide 54. Referring to FIGS. 7 and 8, container 16 is oriented with heel 58 down and toe 56 up in anticipation of installing container 16 with a heel-to-toe motion in which heel 58 is inserted first in towards bay 38 and then toe 56 is rotated down, as indicated by direction arrows 68 and 70 in FIG. 8. Guide 54 blocks toe 56 in this orientation to prevent the user from installing container 16 with a heel-to-toe motion (a motion that may not properly located container outlet 36 over printhead assembly inlet 34 and may permanently damage ink container 16 or printhead assembly 14).

FIGS. 9-10 show an incorrect installation, in which a shipping cap 72 has not been removed from container outlet 36, blocked by guide 54. Referring to FIGS. 9 and 10, guide 54 blocks the now too tall container 16 to prevent the user from trying to push container 16 in on printhead assembly inlet 34. Absent guide 54, attempting to install an ink container 16 without first removing shipping cap 72 may damage the filter or other parts of ink inlet 34. Blocking installation of an ink container 16 with shipping cap 72 installed, therefore, can prevent permanent damage to the fluid interconnection between container 16 and printhead assembly 14.

FIG. 11 is a perspective exploded view of one embodiment of a carriage/printhead assembly 11 in which carriage 12, printhead assembly 14 and container installation guide 54 are each discrete components. Referring to FIG. 11, printhead assembly 14 is attached to carriage 12 with a lever latch 74 or other suitable mechanism. Latch 74 is shown in an open position in which printhead assembly 14 may be removed from or installed into carriage 12. (Latch 74 is rotated down, counterclockwise to secure printhead assembly 14 into position in carriage 12.) Container installation guide 54 snaps onto a rim 76 along a top part 78 of printhead assembly 14, or is otherwise fastened to printhead assembly 14. The details of one example of a suitable snap fit between guide 54 and printhead assembly 14 is described below with reference to FIGS. 12-16.

Figure 12:
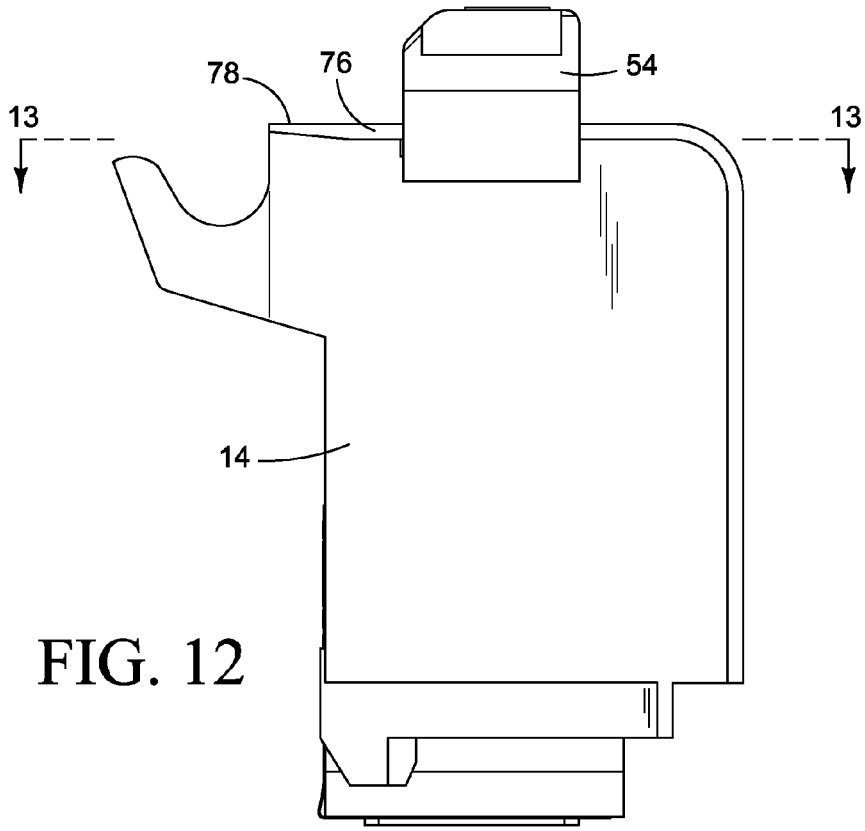
Figure 13:
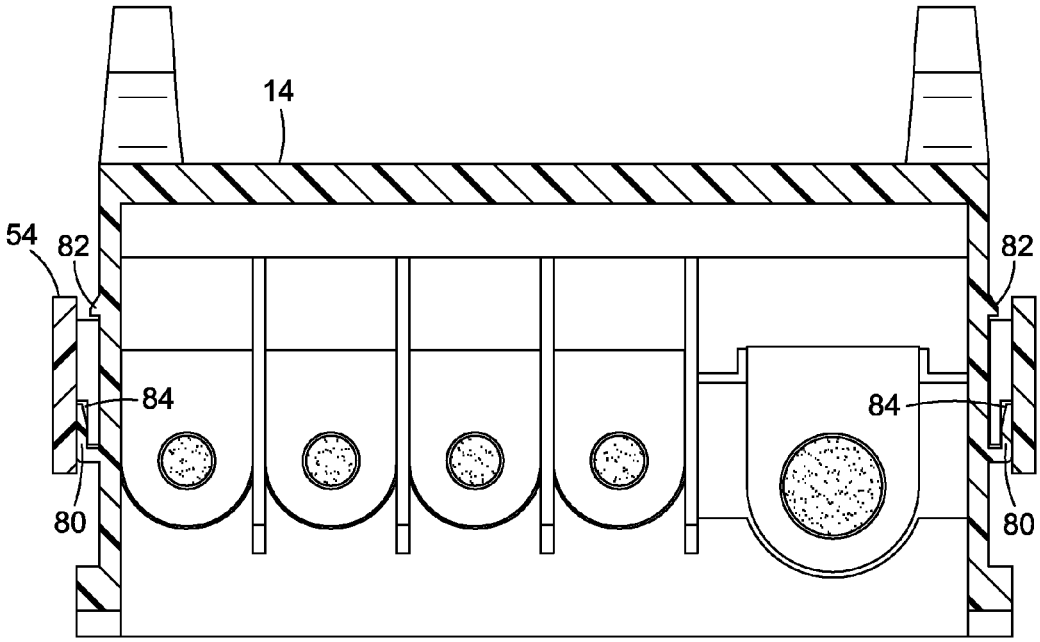
Figure 16:
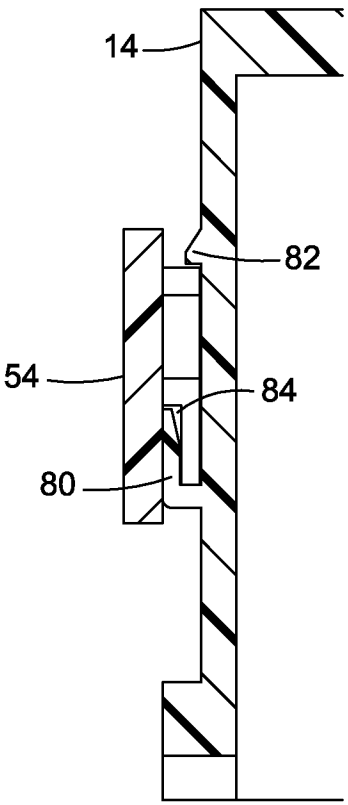
Figure 15:
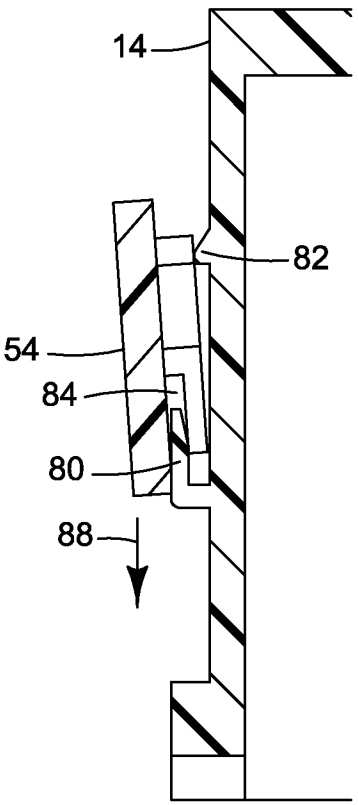
Figure 14:
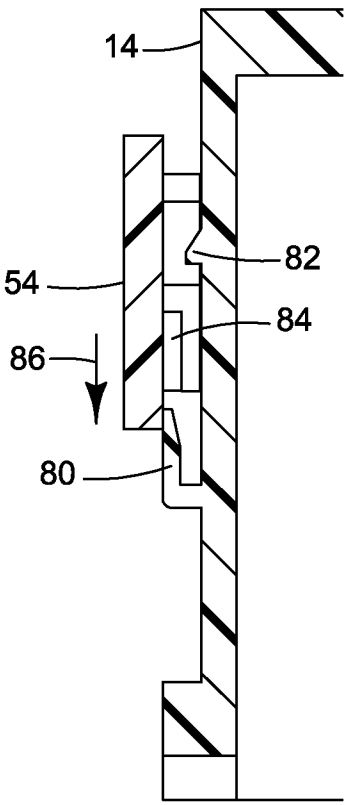

FIGS. 12 and 13 are side elevation and section views, respectively, showing one example snap fit for fastening a detachable container installation guide 54 to a printhead assembly 14. FIGS. 14-16 are a sequence of detailed section views of printhead assembly top part 78 showing the installation of guide 54 onto printhead assembly 14. Referring to FIGS. 12-16, an L-shaped key 80 is formed along the underside of rim 76 at the top part 78 of each side of printhead assembly 14. A protruding stop 82 is formed adjacent to key 80. A mating keyway 84 on each end of guide 54 fits onto key 80 when the ends of guide 54 are placed under rim 76 and snapped into position as best seen by noting direction arrows 86 and 88 in FIGS. 14 and 15, and by comparing the position of guide 54 all of FIGS. 14, 15 and 16. Guide 54 is blocked to the front by key 80 and to the rear by protruding stop 82.

In the embodiments shown, guide 54 is configured as a stationary, generally flat bridge that spans bays 38-46 from side to side over inlets 34 just above the tops of containers 16-24 when containers 16-24 are properly installed in bays 38-46. "Stationary" in this context means stationary with respect to other parts of carriage and printhead assembly 11 even though guide 54 will necessarily move as part of assembly 11, for example as assembly 11 scans back and forth across the print media during printing. This configuration and placement of guide 54 blocks the installation of a container 16-24 using an incorrect, heel-to-toe installation motion or the installation of a container 16-24 that still has a shipping cap in place on outlet 36, without unduly impeding a correct installation. Thus, guide 54 encourages a correct, toe-to-heel installation motion by "guiding" a container 16-24 toward the correct installation position. Other configurations are possible. And, although the configuration and placement of guide 54 may be varied as necessary or desirable according to the particular geometry of carriage/printhead assembly 11 and ink containers 16-24, guide 54 should be configured to block an improper installation without also blocking or otherwise impeding a proper installation.

In the embodiments shown, in which a rectangular ink container 16-24 has outlets 36 that protrude only slightly from a substantially flat bottom surface, guide 54 should be placed no more than about 4.5 mm above the tops of containers 16-24 when containers 16-24 are properly installed in bays 38-46. However, if the container outlets protrude further from the bottom of the ink container, or if an L-shaped container is used with a stepped bottom surface, then the installation guide may be elevated more to increase the clearance for proper installation while still blocking an improper installation. Also, a stationary guide 54 is preferred. A movable guide, attached to the printhead assembly latch for example (lever latch 74 in FIG. 11), is ineffective if the user fails to close/latch the latch. It has been observed in user testing that users don't always close the latch after installing the printhead assembly into the carriage (despite instruction to do so). Rather, users begin installing the ink containers with the latch up, thus allowing an incorrect heel-to-toe installation.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A fluid ejector assembly, comprising:

a bay for holding a detachable fluid container that includes a fluid outlet at a forward part of the container;

a fluid ejector;

a fluid inlet at a forward part of the bay through which fluid front the outlet of a fluid container installed in the bay may pass to the fluid ejector; and a stationary guide configured to block an improper installation of a fluid container into the bay without also blocking a proper installation of the fluid container into the bay;

wherein the guide spans the bay from side to side over the inlet such that the guide blocks installation of a fluid container presented for installation with a heel-to-toe motion but does not block installation of a fluid container presented for installation with a toe-to-heel motion, where the forward part of the fluid container having the outlet characterizes the toe of the fluid container and a rearward part of the fluid container characterizes the heel of the fluid container; and wherein the guide spans the bay from side to side over the inlet such that the guide also blocks installation of a fluid container having a cap covering the outlet.

2. The assembly of claim 1, wherein the bay is at least partially defined by opposing sidewalk and a floor between the sidewalk, the inlet located in the floor and the guide extending between the sidewalk above the floor over the inlet.

3. The assembly of claim 2, wherein the guide comprises a discrete part attached to the sidewalls.

4. The assembly of claim 2, wherein the guide comprises a discrete part attached to and detachable from the sidewalls.

5. A fluid ejector and carriage assembly, comprising:

a fluid ejector assembly including a fluid ejector and a fluid inlet to the fluid ejector;

a carriage carrying the fluid ejector assembly, one or both of the fluid ejector and the carriage defining a bay therein for holding a plurality of removable fluid containers, the fluid inlet located in the bay; and a stationary guide spanning the bay from side to side over the inlet, the guide configured to block installation of a fluid container presented for installation with a forward part of the fluid container, having a fluid outlet for connecting to the fluid inlet, elevated above a rearward part of the fluid container;

wherein the stationary guide comprises a plurality of symbols corresponding to symbols on respective removable fluid containers, each symbol being located along the stationary guide at a location where a removable fluid container with a corresponding symbol is to be installed in the bay.

6. The assembly of claim 5, wherein the guide is attached to or an integral part of the printhead assembly.

7. The assembly of claim 6, wherein the guide comprises a discrete part attached to the printhead assembly.

8. The assembly of claim 5, wherein the guide is suspended over the bay sufficiently close to a level of the top of a container when the container is correctly installed in the bay to block installation of a container having a cap covering the outlet.

9. The assembly of claim 8, wherein the guide is suspended over the bay within 4.5 mm of the top of a container when the container is correctly installed in the bay.

10. An inkjet printhead and carriage assembly, comprising:

a printhead assembly including a printhead for ejecting ink and an ink inlet through which ink may enter the printhead assembly and pass to the printhead;

a carriage carrying the printhead assembly, the printhead assembly and the carriage defining a bay therein for holding a removable ink container, the ink inlet located in the bay; and a stationary guide spanning the bay from side to side over the inlet and snapped to sidewalls of the bay, the guide configured to block installation of an ink container presented for installation with a heel-to-toe motion, where a forward part of the ink container having an ink outlet for connecting to the ink inlet characterizes the toe of the ink container and a rearward part of the ink container characterizes the heel of the ink container.

11. The assembly of claim 10, wherein the guide comprises a discrete part attached to the printhead assembly.

12. The assembly of claim 10, wherein the guide comprises a discrete part attached to and detachable from the printhead assembly.

13. The assembly of claim 10, wherein the guide is further configured to block the installation of an ink container having a cap covering the ink outlet.

14. The assembly of claim 5, wherein the stationary guide rests on sidewalls of the bay.

15. The assembly of claim 14, wherein the stationary guide is snapped onto attachment with said sidewalls of the bay.

16. The assembly of claim 10, wherein:

the bay accommodates a plurality of removable ink containers; and the stationary guide comprises a plurality of symbols corresponding to symbols on respective removable ink containers, each symbol being located along the stationary guide at a location where a removable ink container with a corresponding symbol is to be installed in the bay.

17. The assembly of claim 1, wherein the stationary guide is snapped onto attachment with sidewalk of the bay.

18. The assembly of claim 1, wherein:

the bay accommodates a plurality of removable fluid containers; and the stationary guide comprises a plurality of symbols corresponding to symbols on respective removable fluid containers, each symbol being located along the stationary guide at a location where a removable fluid container with a corresponding symbol is to be installed in the bay.

* * * * *

UNITED STATES PATENT AND TRADEMARK OFFICE

CERTIFICATE OF CORRECTION

PATENT NO. : 8,727,515 B2
APPLICATION NO. : 12/995131
DATED : May 20, 2014
INVENTOR(S) : Daniel D. Dowell et al.

It is certified that error appears in the above-identified patent and that said Letters Patent is hereby corrected as shown below:

In the Claims

In column 5, line 25, in Claim 1, delete “front” and insert -- from --, therefor.

In column 5, line 44, in Claim 2, delete “sidewalk” and insert -- sidewalls --, therefor.

In column 5, line 45, in Claim 2, delete “sidewalk,” and insert -- sidewalls, --, therefor.

In column 5, line 46, in Claim 2, delete “sidewalk” and insert -- sidewalls --, therefor.

In column 6, line 56, in Claim 17, delete “sidewalk” and insert -- sidewalls --, therefor.

Signed and Sealed this
Twenty-sixth Day of August, 2014

Michelle K. Lee

Michelle K. Lee
*Deputy Director of the United States Patent and Trademark Office*